United States Patent [19]

Reid

[11] 4,273,800

[45] Jun. 16, 1981

[54] COATING MASS CONTROL USING MAGNETIC FIELD

[75] Inventor: Paul Reid, New Lambton, Australia

[73] Assignee: John Lysaght (Australia) Limited, Australia

[21] Appl. No.: 963,239

[22] Filed: Nov. 24, 1978

[30] Foreign Application Priority Data

Nov. 24, 1977 [AU] Australia ..... PD 2536

[51] Int. Cl.[3] ..... B05D 3/14

[52] U.S. Cl. ..... 427/47; 427/127

[58] Field of Search ..... 427/47, 127

[56] References Cited

U.S. PATENT DOCUMENTS 3,518,109 6/1970 Halley ..... 427/47

FOREIGN PATENT DOCUMENTS 739130 2/1970 Belgium ..... 427/47

2023900 11/1970 Fed. Rep. of Germany ..... 427/47

42-762 1/1967 Japan ..... 427/47

*Primary Examiner*—Bernard D. Pianalto

*Attorney, Agent, or Firm*—Beveridge, De Grandi, Kline & Lunsford

[57] ABSTRACT

The invention provides a method for removal of an excess of a liquid metal coating from a substrate, such as a hot dip coated metal substrate, and in preferred embodiments, for control of metal coating thickness.

The method involves moving the substrate through a stationary pulsating or alternating magnetic flux. The flux is directed in a path which enters the coating at an entry zone and exits from the coating at an exit zone, those zones being on the external surface of the coating and spaced apart in the direction of advance of the substrate. The frequency and intensity of the flux are controlled so as to exert on the coating surface a force opposing the viscous drag forces exerted in the coating by the moving substrate. Apparatus for use in performing the method is described.

10 Claims, 3 Drawing Figures

COATING MASS CONTROL USING MAGNETIC FIELD

BACKGROUND OF THE INVENTION

When ferrous metal in a continuous length, such as strip, rod, wire or formed shapes of constant cross section is to receive a coating of another metal, it is frequently drawn through a molten pool of coating metal.

As the coated product is withdrawn from the coating bath, on a continuous basis, it is customary to pass it through a stripping zone where any excess coating metal is wiped, or blown off, to produce a more or less even layer on the base metal.

This invention relates to a novel method of removing excess coating metal, which may be zinc, tin, aluminium, lead or various mixtures of these or other coating metals, from the substrate.

According to preferred embodiments the invention provides a convenient method for attaining control of coating mass or for controlling the smoothness of the coated surface.

SUMMARY OF THE INVENTION

According to preferred embodiments of the invention, the commonly used wipers or air jets are replaced with an electromagnetic induction device located at or near the point at which the coated product emerges from the molten pool, so that a stationary pulsating magnetic flux is established in a path which extends into, within for a short distance substantially in the direction of product movement, and then exits from the product. For preference the flux path both enters the product at an entry zone on the coating surface and leaves the product at an exit zone on that surface substantially at right angles to the direction of travel.

The magnetic flux path, after leaving the product through the exit zone, extends through an electromagnetic device containing means for producing an oscillating electromagnetic force. The flux path then extends back to an entry zone to close the flux loop.

This system induces, between the entry and exit zones, a large eddy current in the liquid metal coating surface. Forces of repulsion created between the eddy current and the stationary oscillating field and forces of internal attraction created within the coating causing constriction, act together to smooth the coating and to force excess coating metal from the substrate.

BRIEF DESCRIPTION OF THE DRAWINGS

Apparatus according to the invention will now be described with reference to the accompanying drawings.

DESCRIPTION OF THE PREFERRED EMBODIMENTS

Figure 1:
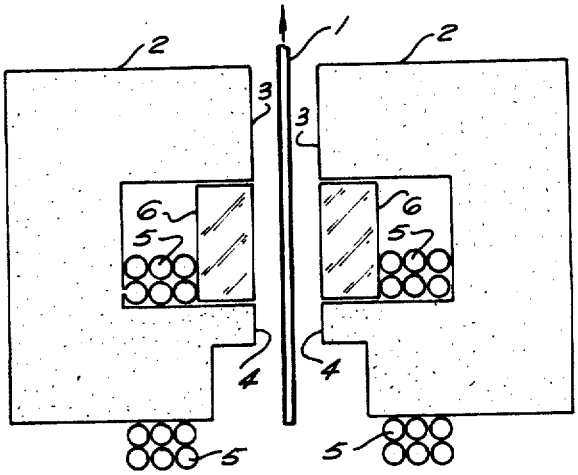
FIG. 1 shows a first embodiment of the invention in cross section.

With reference to FIG. 1 an article 1 for example a strip of a substrate metal coated with a liquid metal coating, applied, for example, by hot dipping, is advancing in the direction indicated with respect to yokes 2. Yokes 2 are of ferromagnetic or ferrimagnetic material and each has a pole face 3 and a pole face 4. The latter, being the upstream pole face with respect to the article advance direction, is preferably narrower than the former.

In the present example coils 5 are used to generate a pulsating or alternating stationary magnetic flux. The yoke 2 provides a return path for the flux loop.

The pole faces are substantially parallel to the coated surfaces and are spaced apart therefrom. For preference a flux barrier 6, for example of copper, shields the centre leg of yoke 2 from the external flux between pole faces 3 and 4 of each yoke 2.

Figure 2:
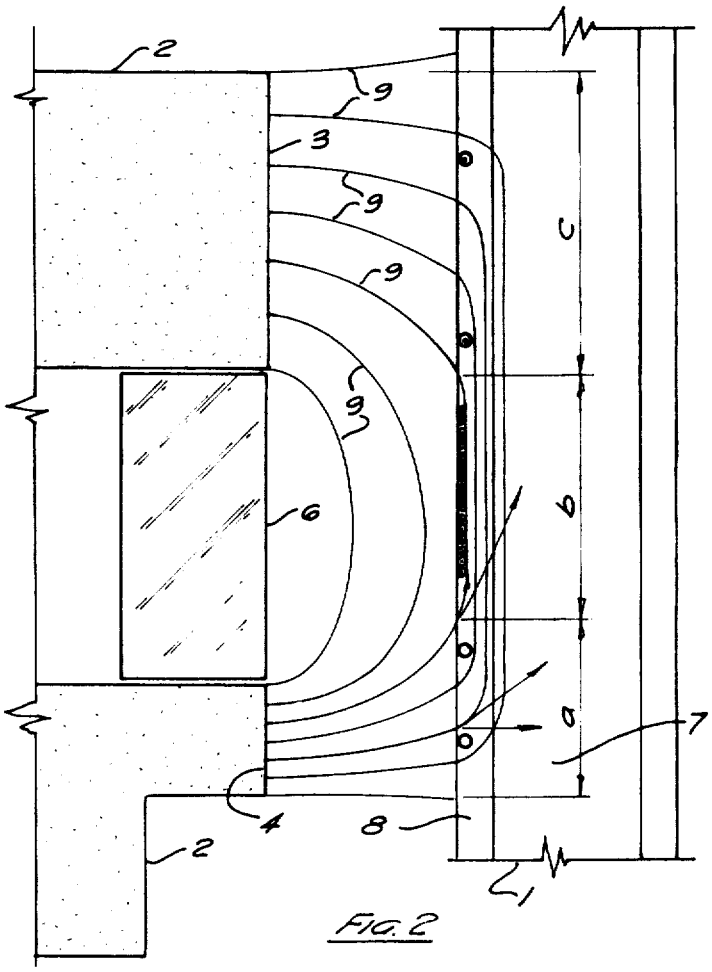
FIG. 2 is a schematic diagram illustrating in more detail the operation of a part of the apparatus shown in FIG. 1.

With reference to FIG. 2 which shows an enlargement of part of FIG. 1, article 1 comprises a substrate 7 and a coating 8. Magnetic flux lines 9 are shown extending from pole face 4 towards article 1 and entering the external surface of coating 8 in an entry zone "a". Part of flux 9 extends along and within coating 8 in zone "b" to emerge from the surface in zone "c", the flux loop being closed via pole face 3 and core 2.

Flux 9 induces an eddy current substantially in the plane of the surface and in a direction perpendicular to the direction of the flux in zone "b" of coating 8 indicated by circles at the surface.

Since the magnetic flux in the base of the coating, increases through zone "a" and reaches a maximum in zone "b", the eddy current density in the coating increases from zero in the vicinity of the leading edge of zone "a" to a maximum in zone "b". Provided the gradient of increase in eddy current density amplitude in the direction of advance from zone "a" is sufficiently great, interaction of the eddy current and the magnetic flux produces forces in the whole of coating 8 sufficient to oppose and overcome the viscous drag of the substrate on the molten surface layer of the coating.

Since the flux density tends to be greater in that area where the two poles are nearest each other, the total magnetic flux in the substrate ranges from minimum to maximum value in a short distance measured in the product advance direction.

The flux density gradient is preferably increased by making pole face 4 as narrow as possible with respect to the advance direction and desirably pole face 3 is made broader than pole face 4. For preferance pole faces 3 and 4 are aligned with the direction of travel so that flux 9 flows through zone "b" of article 1 in the direction of travel and the eddy current in the surface is perpendicular to the direction of travel so that the force opposing viscous drag is at a maximum. As will be apparent the direction of advance of article 1 is preferably at or near to vertical so that viscous drag is also opposed by gravity.

Preferably, copper flux barriers 6 are provided. These help to maintain a satisfactory flux pattern; without them a greater proportion of the magnetic flux would flow from one pole to the other without passing near or through the strip. Their inclusion allows better use of the magnetic flux available as an alternative to increasing the power supply to compensate for such losses. They provide the beneficial side effect of increasing the forces of repulsion between the strip and the inductor which helps not only to prevent the strip from touching the inductors but also to assist in stabilising the wave or flutter of the strip as it emerges from the bath.

The preferred frequency range for the pulsating flux is from 1 to 50 kHz and the intensity of the magnetic field perpendicular to the strip is preferably greater than 0.1 T. Preferred distance of the strip from the pole faces is from 0.1 to 10 mm for sheet or strip material.

When the article is a rod or wire it may be surrounded axially by cylindrical pole faces. Alternatively the pole faces may be in the shape of similarly disposed overlying "U"'s spaced apart with the article running through the tunnel so formed.

To obtain the required stripping forces it is necessary to produce a high density of the magnetic flux passing through the liquid coating into the base material of the strip in the region of the lower pole piece. In the case of a wire strand, this flux concentration necessitates the use of high permeability pole pieces and a close spacing, of the order of 0.5 to 10 mm between the pole faces and the strand. The actual distance is dictated by the ratio between the strand cross section and the surface area of the entry zone. The larger the ratio of cross section to circumference, the longer the distance from the strand surface to the pole faces can be made for the same stripping effect. For example circular steel wire of 2.6 mm diameter can use about 3.2 times the spacing required for flat steel sheet of 0.4 mm face thickness to obtain the same coating thickness.

Operation with distances of only a few millimeters between strand and pole faces is a practical impossibility under production conditions. Unless special precautions are taken, physical contact between strand and pole faces or windings will occur, especially if, for ferromagnetic strand material, magnetic attraction between the strand and the electromagnetic head is present. Such a physical contact can lead to the scraping off of coating metal, causing lumps of solidified coating metal to weld to the moving strand resulting in catastrophic failure. It can also lead to coating defects and to overheating resulting in shattering of pole pieces or failure of electrical insulation.

Figure 3:
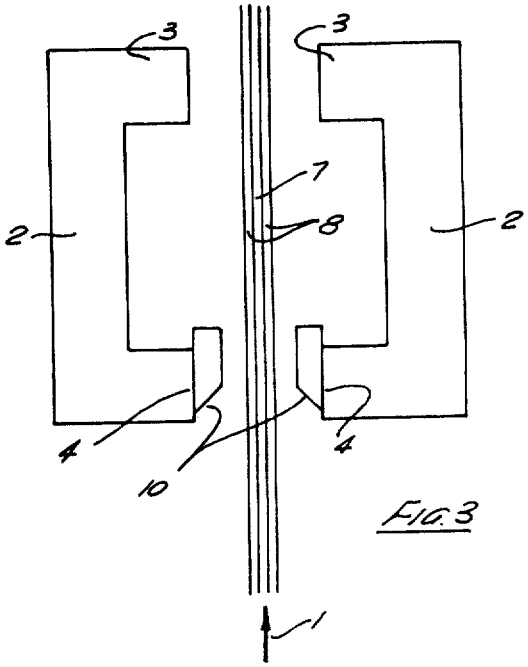
FIG. 3 shows a second embodiment of the invention in cross section.

To prevent this physical contact, in a second embodiment of the invention shown in FIG. 3, direct contact between the strand base material and the pole pieces is prevented by covering the face of the leading pole pieces with a material of low thermal and low electrical conductivity, between 1 and 10 mm thick, with the strand passing through the space bounded by this covering material. The covering extends by a few millimeters above and below the zone of maximum stripping force and the gap is flared to be wider at the upstream edge. Preferably the distance between the strand and the downstream pole face 3 is made wider to avoid physical contact with the strand, reference FIG. 3.

For a strand emerging vertically from the coating bath, the maximum downward directed electromagnetic force which acts on the liquid metal coating in the region of the upper edge of the lower pole faces, forces the liquid metal into the space between the pole cover material and the strand. If the strip is located substantially equidistant from the surface pole cover material there is sufficient gap cross section available to allow the strip of coating material to flow back into the metal bath, but if the strand approaches so close to one side that the return flow contacts the pole cover material, a zone of hydrostatic pressure is formed in the metal film on this side, which forces the strip back towards the central position. Solidification of the liquid metal is avoided by virtue of the low heat conductivity and non-wetting properties of the coating material for which such material as those commercially used for brake linings or ceramics can be used. The substrate of the strand does not contact the strip directly but rather through a thick film of liquid coating metal and scraping does not occur.

In a further embodiment of this invention the frequency of the electric power applied to the coil is made high enough to cause a force of repulsion between the strand and the pole pieces and between the strand and the electrical windings, this force of repulsion increasing with diminishing distance between the strand and the pole pieces or coil. This forces the strand toward the central position.

The minimum frequency required to produce a useful force of repulsion lies above 1 kHz for non-magnetic strand material and above 30 kHz for ferromagnetic material such as steel where forces of attraction have to be overcome. The necessary increase of frequency can result in a reduction of the electro magnetic stripping forces unless the Volt-Amp i.e. the apparent power, applied to the device is increased.

The electromagnetic induction device may assume any convenient form; but is preferably an electric conductor or a coil of electric conductors through which an oscillating or pulsating electric current is made to flow, and which in the case of a conductor extends substantially parallel to the surface of the substrate and substantially at right angles to the direction of travel and in the case of a loop or coil has one side so disposed.

In other embodiments a pair of ferromagnetic or ferrimagnetic pole shoes extending across the surface of the substrate and a rotating or oscillating permanent magnet extending between those pole shoes can be used.

In yet another embodiment a fixed magneto motive force, derived from a DC-current excited coil or from a stationary permanent magnet in combination with a rotating or oscillating magnetic shunt, can be employed to produce the oscillating magnetic field at the pole faces of the yoke.

The yoke or other magnetic devices can be constructed from ferrite, nickel alloy or any other soft magnetic material capable of carrying high frequency alternating magnetic flux.

It will be apparent that the molten metal coating solidifies progressively on the advancing substrate over a distance from the molten metal bath and therefore apparatus according to the invention is only effective prior to solidification of the coating. Preferably the apparatus is located as close as possible to the point of emergence of the article from the bath.

I claim:

1. A method for controlling the thickness of a liquid metal coating on a metal substrate comprising the steps of:

advancing said substrate in an advance direction;

disposing a magnetic yoke having two spaced apart pole faces so that each pole face is adjacent the substrate and on the same side thereof with respect to the advance direction;

generating in said magnetic yoke a pulsating or alternating magnetic flux to produce flux in a looped path which enters said coating at an entry zone, passes along one surface of said coating and said substrate, and exits from said coating at an exit zone, said zones both being on the external surface of said one surface of said coating and spaced apart with respect to said advance direction; and controlling the frequency and intensity of said flux so as to exert on said coating surface a force which opposes viscous drag forces exerted therein by said moving substrate.

2. A method according to claim 1 wherein said flux path direction between said entry zone and said exit zone is said advance direction.

3. A method according to either claim 1 or claim 2 wherein, relative to said advance direction, the width of said entry zone is narrow relative to the width of said exit zone.

4. A method according to claim 1 or claim 2 wherein the frequency of said magnetic flux pulsation or alternation is from 1 to 50 kHz.

5. A method according to claim 1 or claim 2 wherein the intensity of the stationary magnetic flux is greater than 0.1 T perpendicular to the substrate.

6. A method according to claim 1 or claim 2 when said substrate is non-magnetic.

7. A method according to claim 1 or claim 2 when said substrate is ferromagnetic.

8. A method as claimed in any one of claims 1–7 further comprising the step of disposing a flux barrier between said spaced apart pole faces and adjacent said substrate to increase the proportion of the generated flux which flows in the looped path.

9. A method as claimed in claim 1, further comprising the steps of:

disposing a second magnetic yoke having two spaced apart pole faces on the opposite side of said substrate from said first mentioned magnetic yoke so that each pole face of said second magnetic yoke is adjacent the substrate and substantially opposite a corresponding one of the pole faces of said first mentioned magnetic yoke;

generating in said second magnetic yoke a second pulsating or alternating magnetic flux in synchronization with the flux generated by said first mentioned magnetic yoke to produce flux in a looped path which enters said coating at a second entry zone, passes along one surface of said coating and said substrate, and exits from said coating at a second exit zone, said second entry zone and said second exit zone both being on the opposite external surface of said coating and being opposite the entry zone and the exit zone respectively of the flux generated by said first mentioned magnetic yoke and being spaced apart with respect to said advance direction; and controlling the frequency and intensity of said second flux so as to exert on said coating surface a force which opposes viscous drag forces exerted therein by said moving substrate.

10. A method as claimed in claim 9 further comprising the step of disposing a first flux barrier between said spaced apart pole faces of said first mentioned magnetic yoke and adjacent said substrate and disposing a second flux barrier between said spaced apart pole faces of said second magnetic yoke to increase the proportion of the flux generated by each of said first mentioned magnetic yoke and said second magnetic yoke which flows in the respective looped paths.

* * * * *